United States Patent [19]

Spitzer et al.

[11] 4,116,370

[45] Sep. 26, 1978

[54] VAPOR TAP VALVE FOR AEROSOL CONTAINERS USED WITH FLAMMABLE PROPELLANTS

[76] Inventors: Joseph George Spitzer, 44 Coconut Row, Palm Beach, Fla. 33480; Marvin Small, 1100 Park Ave., New York, N.Y. 10021; Lloyd I. Osipow, 2 Fifth Ave., New York, N.Y. 10003; Dorothea C. Marra, 107 Fernwood Rd., Summit, N.J. 07501

[21] Appl. No.: 804,423

[22] Filed: Jun. 7, 1977

Related U.S. Application Data

[63] Continuation-in-part of Ser. No. 754,471, Dec. 27, 1976, which is a continuation-in-part of Ser. No. 706,857, Jul. 19, 1976, Continuation of Ser. No. 774,187, Mar. 3, 1977.

[51] Int. Cl.[2] ..... B65D 83/14; F16K 31/58

[52] U.S. Cl. ..... 222/402.18; 137/38; 222/402.19; 222/500

[58] Field of Search ..... 137/38, 43, 45; 222/402.11, 402.18, 402.19, 402.24, 477, 500

[56] References Cited

U.S. PATENT DOCUMENTS

| | | | |
|---|---|---|---|
| 3,315,693 | 4/1967 | Braun | 137/43 |
| 3,406,877 | 10/1968 | Frangos | 222/402.18 X |
| 3,575,320 | 4/1971 | Prussin et al. | 222/402.18 X |
| 3,593,889 | 7/1971 | Prussin et al. | 222/402.18 X |

*Primary Examiner*—Stanley H. Tollberg
*Assistant Examiner*—David A. Scherbel

[57] ABSTRACT

A vapor tap valve for aerosol containers is provided, for use with aerosol compositions containing liquefied flammable propellants, inhibiting delivery of flammable liquid propellant when the valve is opened immediately after shaking the aerosol container and contents, comprising, in combination, a delivery valve movable manually between open and closed positions and including a valve stem, a delivery port, and a valve chamber; a bias spring in the valve chamber biasing the delivery valve towards a closed position; a liquid tap orifice in flow communication with the valve chamber; a vapor tap orifice in flow communication with the valve chamber; and a shut-off valve linked to and movable with the delivery valve, closing off the vapor tap orifice against entry of liquefied propellant therethrough into the valve chamber when the delivery valve is closed, and opening the vapor tap orifice when the delivery valve is manually moved to the open position, against the biasing force of the bias spring.

25 Claims, 9 Drawing Figures

FIG. 3
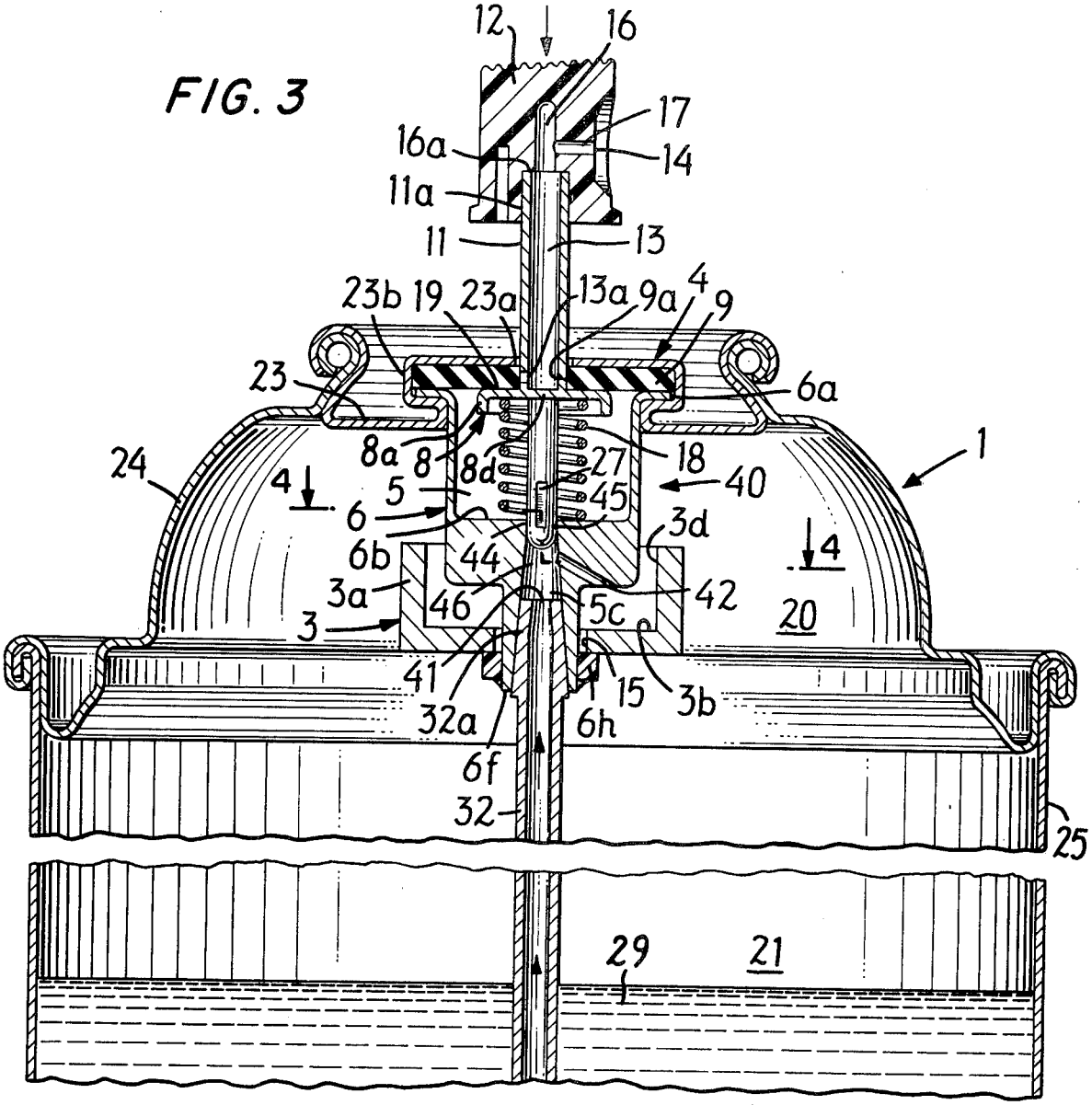
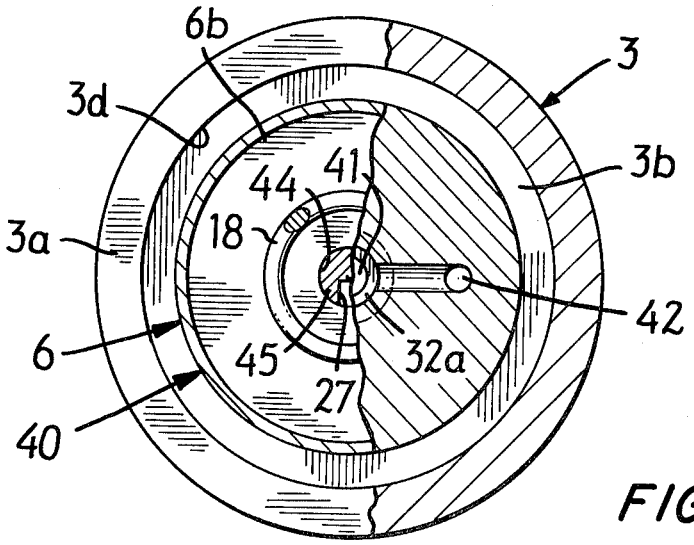
FIG. 4

FIG. 5
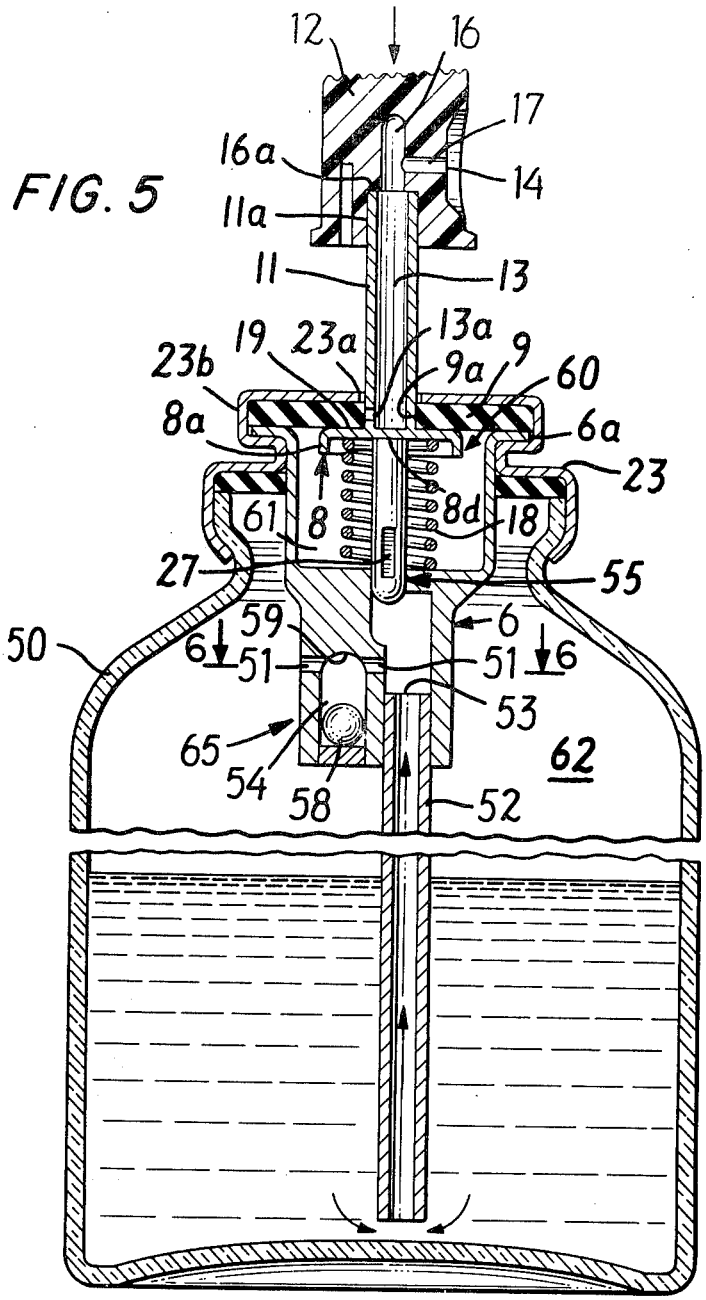
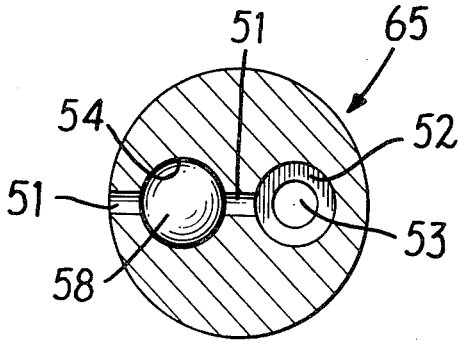
FIG. 6

FIG. 7
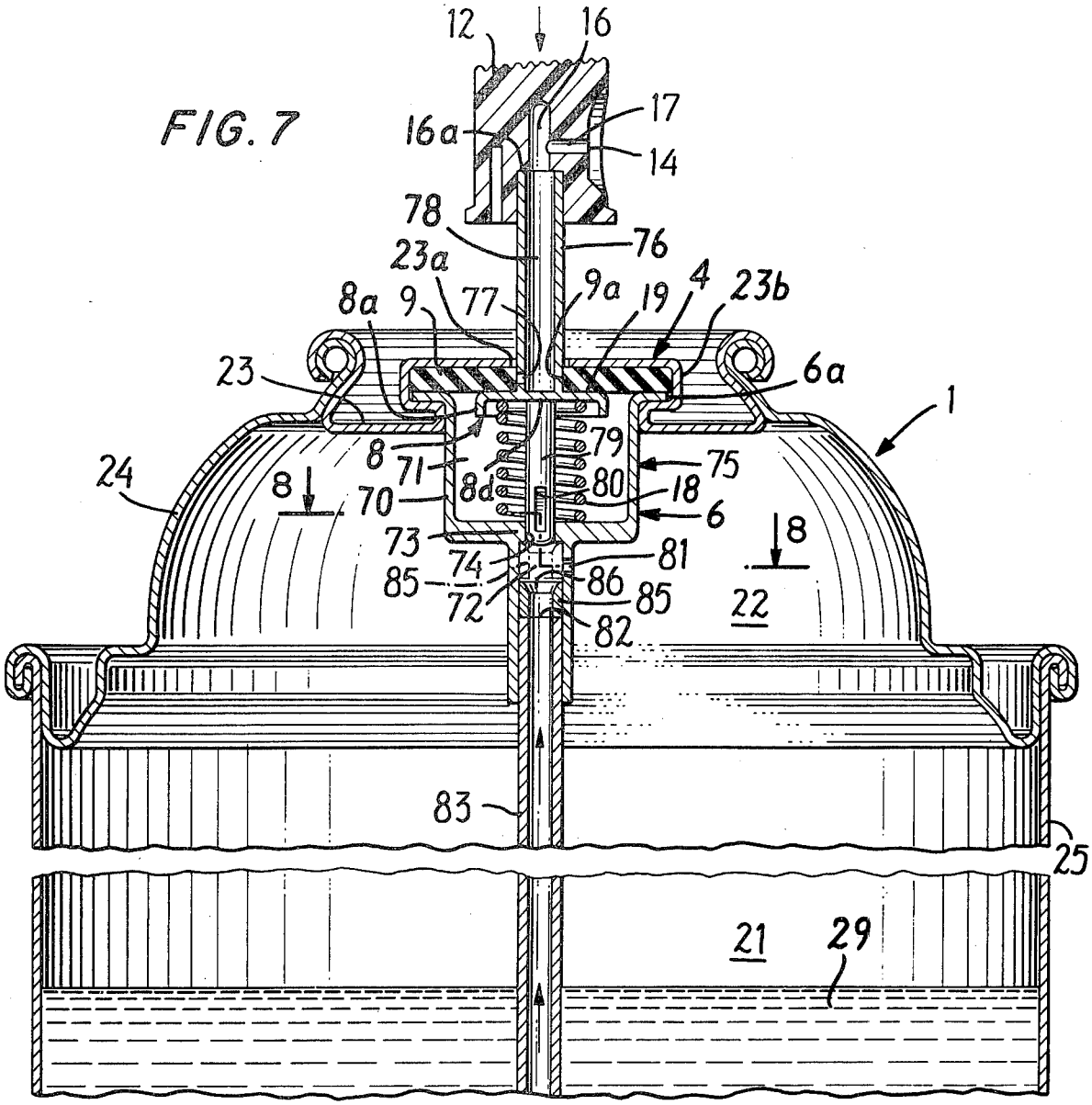
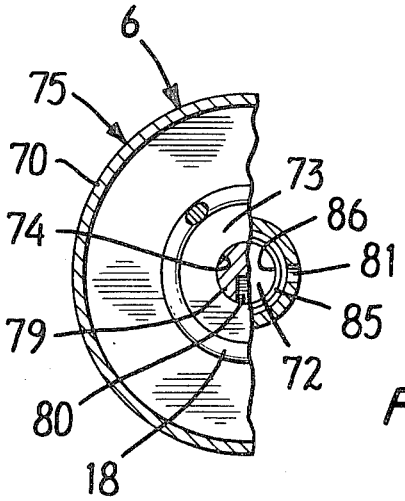
FIG. 8

VAPOR TAP VALVE FOR AEROSOL CONTAINERS USED WITH FLAMMABLE PROPELLANTS

This application is a continuation-in-part of Ser. No. 754,471, filed Dec. 27, 1976, which in turn is a continuation-in-part of Ser. No. 706,857, filed July 19, 1976, now abandoned in favor of continuation Ser. No. 774, 187 filed Mar. 3, 1977.

Aerosol sprays are now widely used, particularly in the cosmetic, topical pharmaceutical and detergent fields, for delivery of an additive such as a cosmetic, pharmaceutical, or cleaning composition to a substrate such as the skin or other surface to be treated. Aerosol compositions are widely used as antiperspirants, deodorants, and hair sprays to direct the products to the skin or hair in the form of a finely-divided spray.

Much effort has been directed to the design of valves and valve delivery ports, nozzles or orifices which are capable of delivering finely-divided sprays, of which U.S. Pat. Nos. 3,083,917 and 3,083,918 patented Apr. 2, 1963, to Abplanalp et al, and 3,544,258 dated Dec. 1, 1970, to Presant et al, are exemplary. The latter patent describes a type of valve which is now rather common, giving a finely atomized spray, and having a vapor tap, which includes a mixing chamber provided with separate openings for the vapor phase and the liquid phase to be dispensed into the chamber, in combination with a valve actuator or button of the mechanical breakup type. Such valves provide a soft spray with a swirling motion. Another design of valve of this type is described in U.S. Pat. No. 2,767,023. Valves with vapor taps are generally used where the spray is to be applied directly to the skin, since the spray is less cold.

Marsh U.S. Pat. No. 3,148,127 patented Sept. 8, 1964 describes a pressurized self-dispensing package of ingredients for use as a hair spray and comprising isobutane or similar propellant in one phase and an aqueous phase including the hair setting ingredient. The isobutane is in a relatively high proportion to the aqueous phase, and is exhausted slightly before the water phases has been entirely dispensed. A vapor tap type of valve is used having a 0.030 inch vapor tap orifice, a 0.030 inch liquid tap orifice, and a 0.018 inch valve stem orifice, with a mechanical breakup button. There is no disclosure of the relative proportions of propellant gas to liquid phase being dispensed.

Rabussier U.S. Pat. No. 3,260,421 patented July 12, 1966 describes an aerosol container for expelling an aqueous phase and a propellant phase, fitted with a vapor tap valve, and capillary dip tube. To achieve better blending of the phases before expulsion, the capillary dip tube is provided with a plurality of perforations 0.01 to 1.2 mm in diameter over its entire length, so that the two phases are admitted together in the valve chamber from the capillary dip tube, instead of the gas being admitted only through a vapor tap orifice, and the liquid through a dip tube as is normal. The propellant is blended in the liquid phase in an indeterminate volume in proportion to the aqueous phase in the capillary dip tube.

Presant et al in U.S. Pat. No. 3,544,258, referred to above, discloses a vapor tap valve having a stem orifice 0.018 inch in diameter, a vapor tap 0.023 inch in diameter with a capillary dip tube 0.050 inch in diameter. The button orifice diameter is 0.016 inch. The composition dispensed is an aluminum antiperspirant comprising aluminum chlorhydroxide, water, alcohol and dimethyl ether. The aluminum chlorhydroxide is in solution in the water, and there is therefore only one liquid phase. The dimensions of the orifices provided for this composition are too small to avoid clogging, in dispensing an aluminum antiperspirant composition containing dispersed astringent salt particles.

The vapor tap type of valve is effective in providing fine sprays. However, it requires a high proportion of propellant, relative to the amount of active ingredients dispensed per unit time. A vapor tap requires a large amount of propellant gas, because the tap introduces a volume of propellant gas into each squirt of liquid. Such valves therefore require aerosol compositions having a rather high proportion of propellant. A high propellant proportion is dangerous and undesirable, however, when the propellant is flammable. For this reason, the art has preferred nonflammable propellants, such as the fluorocarbons. With the imminent banning of fluorocarbon propellants, however, it is now necessary for the art to turn to the flammable propellants, such as hydrocarbons and low boiling ethers, and the resulting flame hazard poses a considerable problem. The flame hazard is increased if liquefied propellant is delivered with gaseous propellant, since the liquid contains more flammable material per unit volume.

Vapor tap valves normally have a rather large valve chamber, in the walls of which are placed the vapor tap and liquid tap orifices. The valve chamber houses the bias means tending to hold the valve in a closed position, and at the same time furnishes blending space for the liquid and gaseous components of the aerosol compositions before delivery when the delivery valve is opened. The liquid tap and vapor tap orifices in the valve chamber are normally open to free entry of both liquid aerosol composition and liquefied propellant or propellant gas at all times, even when the delivery valve is closed. When the aerosol container is shaken up to provide a uniform distribution of two liquid phases or of liquid and solid phases, the valve chamber can and usually does fill with liquid propellant via at least the vapor tap orifice. Upon opening of the delivery valve, the volume of liquefied propellant in the valve chamber is dispensed first, within the first few seconds. This initial delivery of liquefied propellant when the propellant is flammable poses a considerable flame hazard, if the container is used in the vicinity of a flame.

A further problem peculiar to vapor tap valves arises when the container is inclined from the normally upright position to below the horizontal, or even inverted. If the container is inclined or tipped below the horizontal, or inverted, the gas propellant phase can pass through the liquid tap orifice, and the liquefied propellant and liquid aerosol composition can pass through the vapor tap orifice. Since the liquid tap orifice and the vapor tap orifice normally differ in restriction to flow, the ratio of gas to liquid is likely to be completely changed, and the proportion of flammable liquid propellant may be greatly increased, with a resulting increase in flammability of the spray that is dispensed. In this case, an extremely flammable spray can be obtained.

Aerosol containers are commonly filled so that the liquid phase occupies about 60% of the total container capacity at 21° C. With this fill in a container with minimum doming, a straight dip tube, and a vapor tap orifice about 0.6 mm in diameter, off-center and positioned downward when the container is horizontal, both vapor and liquid tap orifices will be covered by liquid when the container is positioned so that the valve is in the range of about −5° (below horizontal) to +5° (above horizontal). If the dip tube bends downward when the container is horizontal, the range in valve position in which both taps are covered by liquid may extend to about −30° (below the horizontal) to about +5° (above the horizontal). The extent or span of this range will depend on the dimensions of the container. The larger the ratio of diameter: height, the wider the span of the range.

In accordance with the invention of Ser. No. 754,471, the fire hazard posed when aerosol containers equipped with conventional vapor tap valves are tipped from the upright position to the horizontal or even inverted position, is overcome by including, in combination with the delivery valve, an overriding shut-off valve which, although normally open when the container is upright, automatically closes off flow of liquid through the delivery valve from the container to the delivery port at some limiting angle at or below the horizontal as the top of the container is brought below the horizontal, towards the fully inverted position. The shut-off valve will normally have closed fully before the container is fully inverted. The angle to the horizontal at which the valve must close is of course the angle at which liquid can flow to the delivery port and escape as liquid from the container, without benefit of a high gas ratio. This can be within the range from 0° (i.e. horizontal) to −90°, and preferably is from −5° to −45°, below the horizontal.

In this type of container, it is generally not possible to dispense the liquid contents of the container by opening the delivery valve unless the container is so oriented that a sufficient ratio of gas is expelled with the liquid phase. The container must be held in a fully upright position, or at least in a position with the valve above the horizontal. Otherwise, the liquid phase cannot flow through the open delivery valve, because the shut-off valve is closed.

The aerosol container in accordance with the invention of Ser. No. 754,471 comprises, in combination, a pressurizable container having at least one storage compartment for an aerosol composition and a liquefied propellant in which compartment propellant can assume an orientation according to orientation of the container between a horizontal and an upright position, and a horizontal and inverted position; a delivery valve movable manually between open and closed positions, and including a valve stem and a delivery port; an aerosol-conveying passage in flow connection at one end with the storage compartment and at the other end with the delivery port, manipulation of the delivery valve opening and closing the passage to flow of aerosol composition and propellant from the storage compartment to the delivery port; and a shut-off valve responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

A preferred embodiment of delivery valve is of the vapor tap type, comprising a valve movable manually between open and closed positions, a valve stem and a delivery port; a valve stem orifice in the valve stem, in flow connection at one end with a blending space, and at the other end with an aerosol-conveying valve stem passage leading to the delivery port; bias means for holding the delivery valve in a closed position; means for manipulating the valve against the bias means to an open position, for expulsion of aerosol composition via the valve stem orifice to the delivery port; wall means defining a blending space, and separating the blending space from liquid aerosol composition and propellant within the container; at least one liquid tap orifice through the wall means; at least one vapor tap orifice through the wall means; and a shut-off valve means movable between a closed position closing off the valve stem passage and an open position allowing aerosol composition to pass through the valve stem passage, the shut-off valve being in the open position at least when the container is fully upright, and being in the closed position at least when the container is fully inverted, and moving from the open to the closed position at an angle therebetween beyond the horizontal at which liquid propellant can flow to and through the vapor tap orifice and escape through the delivery port via the aerosol conveying valve stem passage when the delivery valve is in the open position.

The containers of Ser. No. 754,471 do not however overcome the problem of delivery even when the container is upright, or inclined but above the horizontal, of a highly flammable spray composed predominantly of liquefied flammable propellant when the container is shaken just before the delivery valve is opened, arising from the filling of the valve chamber during shaking with liquefied propellant just before delivery. This is a problem similar to that arising when the container is inverted or held at an angle to the vertical below the horizontal, even though the container may be held fully upright, because the shaking at least partially fills the valve chamber with the liquid phase.

In accordance with the present invention, this difficulty is overcome by providing a vapor tap valve for aerosol containers comprising, in combination, a delivery valve movable manually between open and closed positions and including a valve stem, a delivery port, and a valve chamber; bias means in the valve chamber biasing the delivery valve towards a closed position; a liquid tap orifice in flow communication with the valve chamber; a vapor tap orifice in flow communication with the valve chamber; an aperture forming a passage to the valve chamber and putting the valve chamber in flow communication with at least one of (a) the vapor tap orifice and (b) both the vapor tap orifice and the liquid tap orifice; and a shut-off valve linked to and movable with the delivery valve, closing off the aperture and thereby closing off the flow communication from the vapor tap orifice against entry of liquefied propellant therethrough into the valve chamber when the delivery valve is closed, and opening the aperture and thereby the flow communication from the vapor tap orifice to the valve chamber when the delivery valve is manually moved to the open position, against the biasing force of the bias means.

In a preferred embodiment, the vapor tap valve is combined with a second shut-off valve responsive to orientation of the aerosol container to move automatically between positions opening and closing off flow of propellant to the delivery port via the valve chamber, the shut-off valve moving into an open position in an orientation of the container between a horizontal and an upright position, and moving into a closed position in an orientation of the chamber between the horizontal and an inverted position.

This preferred embodiment of vapor tap valve including first and second shut-off valves inhibits delivery of liquefied propellant under all conditions to which the container may be subjected.

The vapor tap valve has a valve housing which may also include or is in flow connection with wall means defining the valve chamber or blending space. The valve chamber is of limited volume, insufficient to constitute a foam chamber, and only as large as required for thorough blending of gas and liquid therein before reaching the valve. A delivery valve is movably disposed for movement between open and closed positions, away from and towards a valve seat at the inner end of the valve stem passage, with which the valve chamber is in flow connection when the delivery valve is open.

The valve chamber can be small in volume, and no larger than the volume needed for full movement of a delivery valve therein. It can also be a narrow passage, large enough at one end for the delivery valve, and merging indistinguishably with the dip tube or tail piece passage. Any conventional mixing chamber in a vapor tap valve will serve.

The volume of the valve chamber does not usually exceed 1 cc, and can be as small as 0.01 cc, but it is preferably from 0.05 to 0.2 cc.

The liquid tap orifice communicates the valve chamber directly or indirectly with a capillary dip tube or a standard dip tube. A standard or capillary dip tube normally extends into the liquid composition or phase in the aerosol container, and may reach to the bottom of the container. A tail piece may be provided (but is not essential) at the valve housing as a coupling for linking the dip tube to the valve chamber within the valve housing. The tail piece when present has a through passage in fluid flow connection with the liquid composition or phase in the container, via the dip tube, and thence into the valve chamber.

The liquid tap orifice in this embodiment is an orifice or constriction in the passage, at the blending space end, at the dip tube end, or intermediate the ends. The orifice can also be in direct communication with the dip tube, in the event the tail piece is omitted. When the dip tube communicates directly with the liquid tap orifice, the liquid tap orifice can be at the end opening of the dip tube.

In the special case when a capillary dip tube is used, no liquid tap orifice as such is required. The capillary dip tube serves as the liquid tap orifice. However, the size parameters for the capillary dip tube and vapor tap orifice in that event are different, because of the unique flow restriction of the capillary dip tube.

The vapor tap orifice is in fluid flow connection with the propellant or gas phase of the aerosol container, and admits gas into the valve chamber before the valve stem delivery passage. Normally, therefore, it is in the wall defining the valve chamber, and above the liquid tap orifice, although this is not essential. The vapor tap orifice can be in a wall beside or above the shut-off valve, but it is of course upstream of the shut-off valve.

The vapor tap valve delivery system of an aerosol container downstream of the vapor tap delivery valve normally includes an actuator which operates the delivery valve, and movable between open and closed positions against the biasing force at a bias means, with a valve stem and an aerosol composition-conveying valve passage therethrough, in flow connection with a delivery port.

When the valve chamber has a small capacity, e.g., less than about 0.2 cc, it is advantageous that when the first shut-off valve, which is linked with the delivery valve, is in an open position it is in flow communication with both the vapor tap orifice and the liquid tap orifice. This facilitates mixing of the gas and liquid phases which occurs in the valve chamber, before these pass to the delivery valve, and the diameters of the vapor tap and liquid tap orifices as well as the valve passages and orifices with which they are in communication are selected within the stated ranges to provide, in the valve chamber, a gas:liquid volume ratio within the range from about 8:1 to about 40:1, and preferably from about 15:1 to about 30:1. It will be appreciated that for a given size of these openings, the gas:liquid ratio obtained from gas and liquid fed therethrough from the supply in the container will vary with the particular propellant or propellants and the composition of the liquid phase. The viscosity of the liquid is a factor in determining the proportion that can flow through the liquid tap orifice per unit time, when the valve is open.

In a preferred embodiment of this type of valve, where particulate solids are either absent or present in too small a size or concentration to constitute a potential clogging problem, the valve stem orifice has a diameter within the range from about 0.3 to about 0.65 mm, at least one liquid tap orifice having a cross-sectional open area within the range from about 0.1 to about 0.8 $mm^2$, and at least one vapor tap orifice having a cross-sectional open area within the range from about 0.1 to about 0.8 $mm^2$, the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In a preferred embodiment of this type of valve, where particulate solids are present with a particle size and concentration that could clog small orifices, the valve stem orifice has a diameter within the range from about 0.5 to about 0.65 mm, at least one liquid tap orifice having a cross-sectional open area within the range from about 0.4 to about 0.8 $mm^2$, and at least one vapor tap orifice having a cross-sectional open area within the range from about 0.3 to about 0.8 $mm^2$, the ratio of liquid tap orifice to vapor tap orifice cross-sectional open area being within the range from about 0.5 to about 2.3; the open areas of the liquid tap orifice and vapor tap orifice being selected within the stated ranges to provide a volume ratio of propellant gas:liquid aerosol composition within the range from about 8:1 to about 40:1, limiting the delivery rate of liquid aerosol composition from the container when the valve is open.

In the special case where the liquid tap orifice is a capillary dip tube, and particulate solids are not present in size or amount to clog small orifices, the cross-sectional open area thereof is within the range from about 0.1 to about 1.8 $mm^2$, for flow of liquid aerosol composition into the valve chamber, and at least one vapor tap orifice through the wall has a cross-sectional open area within the range from about 0.1 to about 0.8 $mm^2$ for flow of propellant gas into the blending space; and the ratio of capillary dip tube to vapor tap orifice cross-sectional open area is within the range from about 1.0 to about 3.2.

In the special case where the liquid tap orifice is a capillary dip tube, where the solids are present in size or amount to clog small orifices, the cross-sectional open area thereof is within the range from about 0.6 to about 1.8 $mm^2$, for flow of liquid aerosol composition into the valve chamber, and at least one vapor tap orifice through the wall has a cross-sectional open area within the range from about 0.3 to about 0.8 $mm^2$ for flow of propellant gas into the valve chamber; and the ratio of capillary dip tube to vapor tap orifice cross-sectional open area is within the range from about 1 to about 3.2.

The controlling orifices to achieve the desired proportion of gas and liquid in the blend dispensed from the container are the vapor tap orifice, the liquid tap orifice (or in the case of a capillary dip tube, the capillary dip tube), and the valve stem orifice. The open areas of these orifices and the ratio of liquid tap orifice to vapor tap orifice open area should be controlled within the stated ranges. However, these dimensions are in no way critical to the operation of the shut-off valve, which can be used advantageously with delivery valves having other dimensions.

The valve delivery system normally includes, in addition to the valve stem orifice, an actuator orifice at the end of the passage through the actuator of the valve. The valve delivery system from the valve chamber through the valve stem and actuator to the delivery port thus includes, in flow sequence towards the delivery end, the valve stem orifice, the valve stem passage, and the actuator orifice. Th controlling orifice in this sequence is the valve stem orifice, and the actuator orifice will normally have a diameter the same as or greater than the valve stem orifice, but not necessarily.

In the unlikely event that the actuator orifice has an open area that is less than the valve stem orifice, then the actuator orifice becomes the controlling orifice, downstream of the blending chamber, and its diameter may in that event be within the range from about 0.3 to about 0.65 mm when solids are not present, and from about 0.45 to about 0.65 mm when solids are present in sufficient amount or size to clog small orifices.

The orifice ranges given are applicable to dispersion-type antiperspirant aerosol compositions. Other orifice ranges may be used with other types of aerosol compositions.

The invention is also applicable to aerosol containers which have at least two compartments, a first aerosol composition compartment and a second liquefied propellant gas compartment, the propellant compartment and the valve and chamber being communicated by at least one vapor tap orifice, which is across the line of flow through the valve chamber to the valve delivery port from the propellant compartment. A liquid aerosol composition to be foamed and then expelled from the container is placed in the first compartment of the container, which is in flow communication via a liquid tap orifice with the valve chamber, so as to admit liquid aerosol composition into the valve chamber across the line of propellant gas flow via the gas orifice or orifices to the delivery valve. When the delivery valve is opened, the propellant passes in gaseous form through the vapor tap orifice(s) and propels the liquid aerosol composition to and through the open delivery valve passage out from the container.

The overall dimensions of the vapor tap and the liquid tap orifice(s) are selected according to the required product delivery rate (including propellant expelled).

Both the vapor tap and liquid tap orifices are in a wall or walls defining the valve chamber or housing. The liquid tap orifice is placed so that liquid aerosol composition entering the valve chamber is disposed across the line of flow from the vapor tap orifice into the valve chamber and out from the container. The liquid tap orifice can be below, above, or on a line with the vapor tap orifice.

The function of the shut-off valve of the invention is to prevent liquid aerosol composition containing flammable liquefied propellant from entering the valve chamber when the container is shaken. This liquid composition readily enters the valve chamber through the vapor tap orifice, as well as through a liquid tap orifice communicating with a standard dip tube. In the case where the liquid tap orifice is a capillary dip tube of narrow bore, very little liquid will enter the valve chamber through the capillary, but it can enter through the vapor tap orifice.

Thus, it is always essential that the shut-off valve close off the flow communication between the valve chamber and the vapor tap orifice. While it may also be necessary that it close off the flow communication between the valve chamber and the liquid tap orifice to entry of liquefied propellant into the valve chamber if that orifice is large, it is usually unnecessary, and therefore optional to do so.

The shut-off valve of the invention opens and closes an aperture forming a passage to the valve chamber and putting the valve chamber in flow communication with the vapor tap orifice and the liquid tap orifice. This aperture can be placed at any convenient location across the line of flow of propellant liquid or gas through the vapor tap orifice into the valve chamber of the vapor tap valve. Thus, it can be placed directly across or beside the vapor tap orifice. It can also be placed in the valve chamber downstream of the liquid tap orifice in the valve chamber. If shut-off valve is downstream of the liquid tap orifice, it of course closes off the valve chamber to filling with liquid propellant from both liquid tap and vapor tap orifices, while if it is across only the vapor tap orifice, shut-off valve prevents entry of liquefied propellant into the valve chamber, but only through the vapor tap orifice. If the liquid propellant can readily enter the valve chamber through both the vapor tap and the liquid tap orifices by shaking, it is of course desirable to put the shut-off valve downstream of both the liquid tap and vapor tap orifices in the valve chamber.

It is sufficient to close off the vapor tap orifice when the liquid tap orifice is a capillary dip tube with a small inside diameter, e.g., 0.4 mm.

It is necessary that the shut-off valve be linked to the delivery valve, so that when the delivery valve is opened, the shut-off valve is opened as well, thus making possible the passage of both liquid and gas into the valve chamber and through the delivery system to the delivery port.

Accordingly, a preferred embodiment of shut-off valve has both shut-off valve and delivery valve means attached to a valve stem, and movable therewith between open and closed positions, opening and closing together at least both the vapor tap orifice and the delivery valve.

In a preferred embodiment, both the delivery valve and the shut-off valve are slide valves, movable together into the open position against the biasing force of the bias means by manual manipulation of the valve actuator. The shut-off valve is in the form of a reciprocable shaft or cylinder, with at least one flow passage therethrough movable therewith between an open position in which at least both the valve chamber and the vapor tap orifice are linked in fluid flow communication via the passage, and a closed position in which the passage is not in registration with the valve chamber and the vapor tap orifice; and bias means holding the shut-off valve in the closed position.

The valve accordingly prevents entry of liquefied propellant through the vapor tap orifice when the container is shaken, because when the container is shaken the delivery valve is closed, and with it flow communication with the vapor tap orifice. The vapor tap orifice is normally closed, and is opened only when the delivery valve is also opened, for delivery of aerosol composition from the container.

In order to prevent delivery of flammable liquefied or gaseous propellant when the container is in an inclined or inverted position, the vapor tap valve of the invention and aerosol containers including the same can also include a second shut-off valve, of the type described in Ser. No. 754,471. This second shut-off valve can be placed in any convenient location across the line of flow of liquid to the delivery port.

Thus, it can be at or in the passage leading directly to the delivery port, downstream or upstream of the delivery valve, in the valve chamber, or at or in the vapor tap orifice.

It is sufficient to close off the vapor tap orifice, if there be a dip tube leading to the liquid tap orifice, since this will prevent escape of liquid. However, the shut-off valve can also be arranged to close off the valve stem orifice, or the valve chamber, or the valve stem passage. In all such cases, all flow is cut off, even if the manipulatable valve be open.

The second shut-off valve in accoredance with the invention can take any of several forms.

A preferred embodiment of shut-off valve has a valve means which is free to roll with gravity, such as a cylinder or ball, which can roll freely along an inclined guide, chute or support, into a position at the valve seat closing off the valve passage when the container is in any position between a few degrees less than horizontal to fully inverted, i.e., from −2° to −90° below the horizontal, but which normally is drawn by gravity into an at-rest position in which the shut-off valve is open when the top of the container is in any position between a few degrees below the horizontal to fully upright, i.e., +90°. As the container is brought from an upright position toward the horizontal, the ball or cylinder can roll down towards the valve seat, and at some angle near the horizontal will roll into position on the valve seat, closing off flow to the valve passage. The flammability hazard is eliminated when the container is in any position.

This embodiment is especially suitable for disposition in a valve chamber, or across a delivery valve stem passage or orifice, including a vapor tap valve in the ball housing.

Another embodiment of the shut-off valve of the invention is a slide valve, slidable along a guide between open and closed positions. In the open position, the slide valve is away from the valve seat and the valve passage is open. As the container is brought into a fully inverted position at an angle at about 10° or so beyond the horizontal, the slide valve slides along the guide into contact with the valve seat, closing off the valve passage.

The slide valve can for example be tubular and arranged to slide along a concentric tubular guide, the guide constituting a dip tube, or a wall enclosing the valve chamber. The vapor tap or valve stem orifice extends radially through the tubular guide, or is disposed axially at one end of the tubular guide. In the former case, the side of the tubular slide valve can be arranged to close off the orifice through the tubular guide. In the latter case, the end of the slide valve can be arranged to close off the orifice, when brought into abutting relation therewith.

Another form of slide valve has a disc with a flanged outer periphery, movable along the concentric tubular guide. The orifice or passage to be closed off is axially disposed, in a wall of a valve chamber. It can for example be a vapor tap orifice through the bottom wall of the valve chamber. The vapor tap orifice is accordingly closed off when the disc comes into abutment with the bottom wall, guided in this position by the tubular guide.

Other variations will be apparent to those skilled in this art.

Preferred embodiments of aerosol containers in accordance with the invention are illustrated in the drawings, in which:

FIG. 1 representa a fragmentary sectional view of an aerosol container having therein one embodiment of vapor tap valve in accordance with the invention, including a vapor tap orifice and a liquid tap orifice in the form of a capillary dip tube in fluid flow connection with the shut-off valve of the invention arranged as a reciprocable slide valve at one end of the valve stem of the delivery valve, and movable within an aperture in a valve plate extending all the way across the valve chamber, closing off the valve chamber when in the closed position, and showing the shut-off valve in the closed position.

FIG. 3 represents a fragmentary longitudinal sectional view of another embodiment of vapor tap valve in accordance with the invention, including a capillary dip tube in fluid flow connection with the liquid tap orifice;

FIG. 4 represents a cross-sectional view taken along the line 4—4 of FIG. 3;

FIG. 5 represents a longitudinal sectional view of another embodiment of vapor tap valve in accordance with the invention, designed for use with a pressure bottle, rather than an aerosol can;

FIG. 6 represents a cross-sectional view taken along the line 6—6 of FIG. 5;

FIG. 7 represents a longitudinal sectional view of another embodiment of vapor tap valve in accordance with the invention, arranged to close off the valve chamber at one end, downstream of both the liquid tap and vapor tap orifices, and FIG. 8 represents a cross-sectional view taken along the line 8—8 of FIG. 7.

In principle, the preferred aerosol containers of the invention utilize a container having at least one compartment for propellant gas and liquid aerosol composition, communicated by at least one vapor tap orifice and at least one liquid tap orifice to a valve chamber of a vapor tap valve which is across the line of flow to the valve delivery port. A liquid aerosol composition to be blended with propellant gas and then expelled from the container is placed in this compartment of the container, in flow communication via the liquid tap orifice with the valve chamber, so as to admit liquid aerosol composition into the valve chamber, while propellant gas flows into the valve chamber via the vapor tap orifice or orifices to the valve.

The aerosol containers in accordance with the invention can be made of metal or plastic, the latter being preferred for corrosion resistance. However, plastic-coated metal containers can also be used, to reduce corrosion. Aluminum, anodized aluminum, coated aluminum, zinc-plated and cadmium-plated steel, tin, and acetal polymers such as CELCON or DELRIN are suitable container materials.

Figure 1:
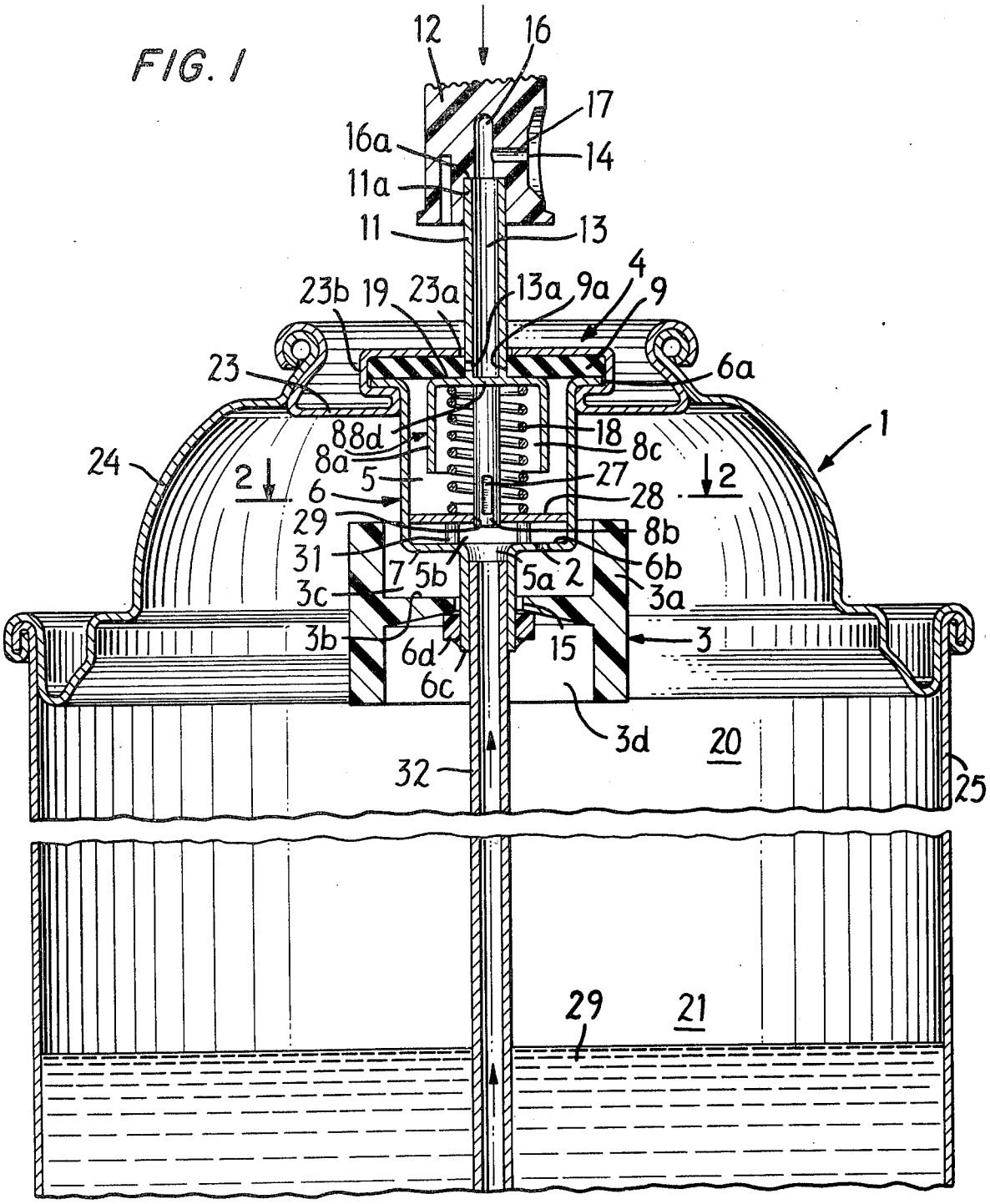
FIG. 1A represents a detailed view of the vapor tap valve of FIG. 1, showing the shut-off valve in the open position.
Figure 1A:
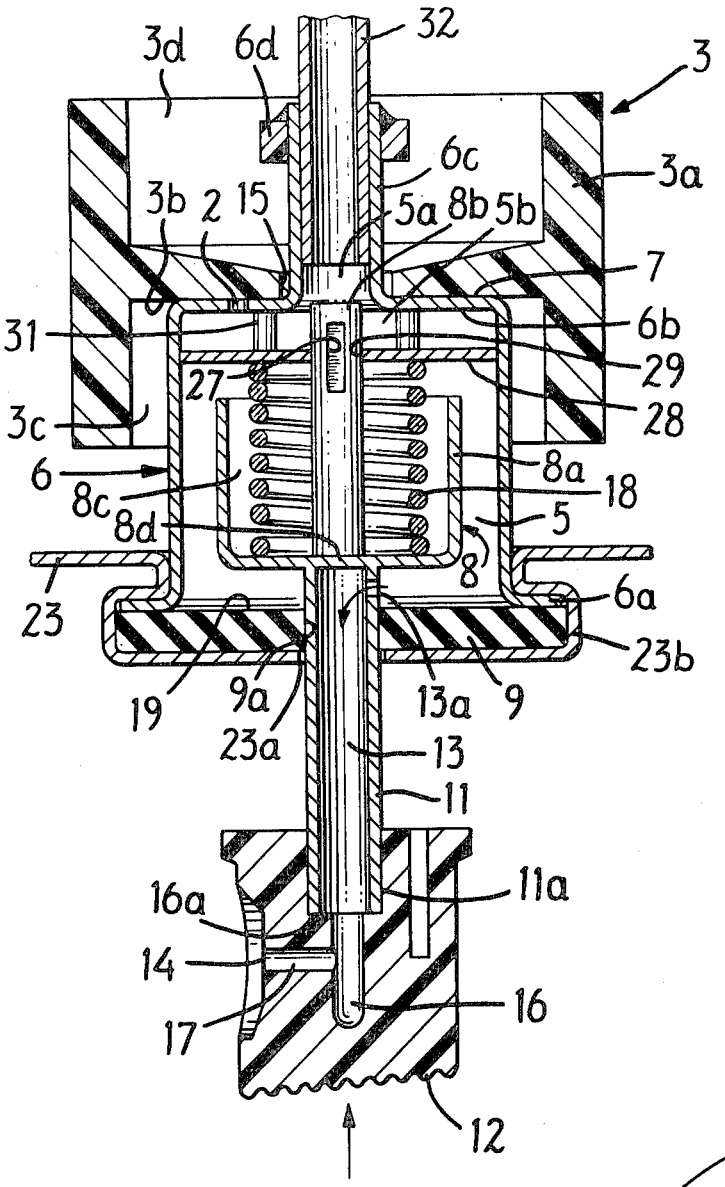
Figure 2:
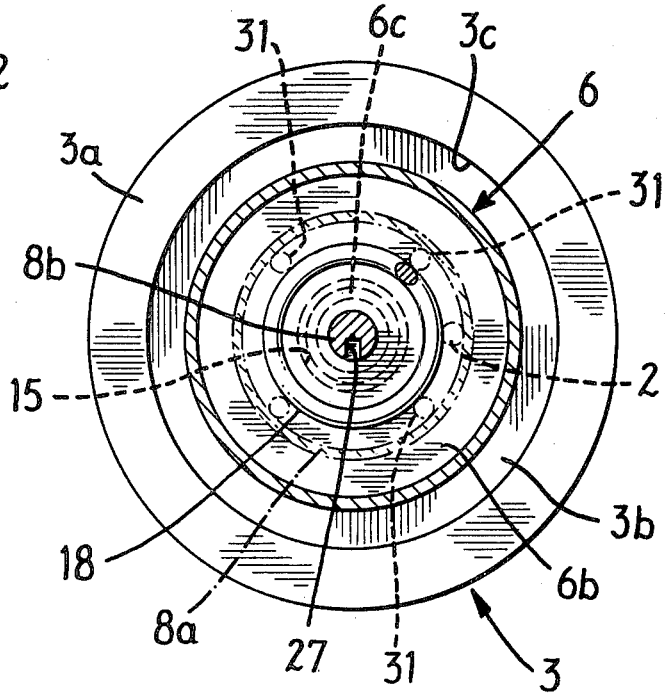
FIG. 2 represents a cross-sectional view taken along the line 2—2 of FIG. 1.

The aerosol container 1 shown in FIGS. 1, 1A and 2 has a vapor tap valve 4 of the invention comprising a valve poppet 8 combining in one member a delivery valve poppet 8*a* and a shut-off slide valve 8*b*. The delivery valve poppet 8*a* seats against the sealing face 19 of a sealing gasket 9. The shut-off slide valve 8*b* reciprocates through and against the inside wall of the aperture constituting a valve seat 29 of a valve plate 28. The valve plate extends all the way across the valve chamber 5, separating a lower portion 5*b* into which open the vapor tap orifice 2 and liquid tap orifice 5*a*. The poppet 8*a* is open at the inner end, and defines a socket 8*c* therein for the reception of a coil spring 18. The passage 13 is separated from the socket 8*c* within the poppet 8*a* by the divider wall 8*d*.

Adjacent the divider wall 8*d* in a side wall of the stem 11 is a valve stem orifice 13*a*. The gasket 9 has a central opening 9*a* therethrough, which receives the valve stem 11 in a sliding leak-tight fit, permitting the stem to move easily in either direction through the opening without leakage of propellant gas or liquid from the container.

When the valve stem is in the outwardly extended position shown in FIG. 1, the surface of the poppet portion 8*a* contiguous with wall 8*d* is in sealing engagement with the inner face of the gasket 9, closing off the orifice 13*a* and the passage 13 to outward flow of the contents of the valve chamber 5.

The slide valve 8*b* has a solid shaft tip, with a central groove 27 open on one side, and considerably longer than the thickness of the valve plate 28. With the valve 8*b* and the valve stem 11 in the position shown in FIG. 1, the groove is entirely within the valve chamber 5, and therefore access from the chamber 5 to the space 5*b* below the valve plate 28 is closed off by the valve 8*b*. When however the valve stem 11 is moved inwardly by the button actuator 12, the groove 27 is also moved inwardly, and in the fully depressed position of the valve stem, the groove 27 provides a flow communication between the valve chamber 5 and the space 5*a* below the valve plate 28. With the valve in the position shown in FIG. 1, entry into chamber 5 of both gas and liquid passing through the gas and liquid tap orifices 2 and 5*a* is prevented by the valve 8*b*, and thus the valve 8*b* closes off the valve chamber 5 to outward flow of all of the contents of the container, upstream of the valve 8*b*.

The outer end portion 11*a* of the valve stem 11 is received in the axial socket 16 of the button actuator 12, the tip engaging the ledge 16*a* of the socket. The stem is attached to the actuator by a press fit. The axial socket 16 is in flow communication with a lateral passage 17, leading to the actuator (valve delivery) orifice 14 of the button 12.

The compression coil spring 18 has one end retained in the socket 8*c* of the valve poppet 8*a*, and is based at its other end upon valve plate 28. The spring 18 biases the poppet 8*a* towards the gasket 9, engaging it in a leak-tight seal at the valve seat 19. When the valve poppet is against the valve seat 19, the orifice 13*a* leading into the passage 13 of the valve stem is closed off.

The delivery valve is however reciprocably movable towards and away from the valve seat 19 by pressing inwardly on the button actuator 12, thus moving the valve stem 11 and with it poppet 8*a* against the spring 18. When the valve is moved far enough away from the seat 19, into the position shown in detail in FIG. 1A, the orifice 13*a* is brought beneath the valve gasket 9, and a flow passage is therefore open from the valve chamber 5 defined by the valve housing 6 to the delivery port 14.

At the same time, the shut-off valve 8*b* is moved inwardly in aperture 29 so that the groove 27 is brought into registry at one end with valve chamber 5 and at the other end with the space 5*b* below the chamber, and a flow passage is therefore opened through the groove 27 from the space 5*b* into the valve chamber 5 defined by the valve housing 6, and thence to the delivery port 14 via the open valve stem orifice 13*a*.

The limiting open position of the valve poppet 8*a* and shut-off valve 8*b* is fixed by the spring 18, which can be compressed at most to the position where the coils of the spring are in contact with each other.

The valve stem orifice 13*a* when in the open position communicates the stem passage 13 with the actuator passages 16, 17 and the valve delivery orifice 14, and thus depressing the actuator 12 permits fluid flow past the shut-off valve 8*b* and the valve stem orifice 13*a* via the valve chamber 5, to be dispensed from the container at delivery port 14.

Thus, the spring 18 ensures that the valve poppet 8*a* and the shut-off valve 8*b* are normally in a closed position, and that the two valves are open only when the button actuator 12 is moved manually against the force of the spring 18.

The valve housing 6 has an expanded portion 6*a* upon which is the sealing gasket 9, and retained in position at the upper end of the housing. The expanded portion 6*a* and the sealing gasket 9 are retained by the crimp 23*b* in the center of the mounting cup 23, with the valve stem 11 extending through an aperture 23*a* in the cup. The cup 23 is attached to the container dome 24, which in turn is attached to the main container portion 25.

Through the bottom wall 7 of the valve housing 6 is a vapor tap orifice 2, which is in flow connection with the upper portion 20 of the space 21 within the container 1, and therefore with the gas phase of propellant, which rises into this portion of the container. Below the valve plate 28 the space 5*b* of the valve housing 6 terminates in a passage 5*a*, enclosed in the projection 6*c* of the housing 6. In the passage 5*a* is inserted one end of the capillary dip tube 32, which extends all the way to the bottom of the container, and thus dips into the liquid phase of the aerosol composition in portion 21 of the container. Liquid aerosol composition accordingly enters the space 5*b* at the passage 5*a*, via the capillary dip tube 32, so that the dip tube serves as a long liquid tap orifice, while gas enters the space 5b through the gas tap orifice 2.

In the valve shown, the diameter of the actuator (valve delivery) orifice 14 is 0.5 mm. The valve stem orifice 13a is 0.6 mm. The diameter of the vapor tap orifice 2 is 0.95 mm, and the inside diameter of the capillary dip tube 32 is 1.0 mm. The valve chamber 5 has a length of 1 cm, and an inside diameter of 0.78 cm. The stem shaft 11 has a diameter of 0.3 cm, and extends almost to the bottom of the space 5b when the valves 8a, 8b are opened. The groove 27 in the valve stem 11 has a rectangular shape, 0.08 cm deep, with a length of 0.4 cm and a width of 0.08 cm, starting 0.1 cm from the bottom of the stem shaft. The shaft 11 fits snugly in a leak-tight fit in the aperture 29 of the valve plate 28. The aperture has an inside diameter of 0.3 cm, the same as the outside diameter of the valve stem. The valve plate 28 is located 0.2 cm above the bottom wall of the valve chamber 5 and is held in position, spaced from the lower wall 6b of the valve chamber 5, by the spring 18 and the lugs 31.

The volume of the valve chamber 5 is about 0.4 cc, and the volume of the space 5b between the valve plate and the capillary dip tube is about 0.1 cc.

In operation, button 12 is depressed so that the valve stem 11 and with it valve poppet 8a, orifice 13a, and shut-off valve 8b are manipulated to the open position, away from the valve seats 19 and 29. Liquid aerosol composition is thereupon drawn up via the capillary dip tube 32 and the passage 5a into the space 5b, whence if flows through the aperture 29 into the valve chamber 5, and then up around the poppet 8a towards the valve stem orifice 13a. Propellant gas passes through the vapor tap orifice 2, and is blended with liquid aerosol composition in the spaces 5b and 5, which it enters via the aperture 29 as it flows past the valve plate 28, and then flows around the poppet 8a through the valve stem orifice 13a and the valve stem passage 13 and valve button passages 16, 17, through the delivery orifice 14. The dimensions of the orifices 2, 32 are such that at least 8 volumes of gas enter through the vapor tap orifice 2 for each volume of liquid entering through the liquid tap orifice, which is the capillary dip tube 32.

This embodiment of container includes a second shut-off valve, slide valve 3, arranged to close off the vapor tap orifice 2 when the container is inverted, or inclined below the horizontal. The slide valve 3 has a valve body of plastic, for example polyethylene or polypropylene, with an annular rim 3a and a central disc valve 3b. The rim defines twin recesses 3c and 3d, of which recess 3c is wide enough and deep enough to receive the end 6b of the valve housing 6, and all of wall 7. When it does so, the disc valve 3b eventually abuts and covers over the bottom wall 7 of the valve housing 6, thus effectively closing off the vapor tap orifice 2, when the valve 3 is in the uppermost position. Accordingly, the valve in this position closes off the vapor tap orifice 2.

The disc valve 3b has a central aperture 15 through which passes loosely the projection 6c of the valve housing 6. The loose fit prevents binding of the disc against the projection 6c. The annular rim 3a is long enough to engage the housing 6 over the entire travel of the valve along projection 6c between the closed position abutting the bottom wall 7 of the housing 6, and the open position abutting the stops 6d on the projection 6c. In the open position, the valve disc 3b is in the lowermost position, and rests against the stop 6d, as shown in FIG. 1. In this position, the container is upright and the valve under the force of gravity remains in this position.

It will be apparent, however, that when the container is inverted, the valve will tend to slide along the projecton 6c into the newly lowermost position (corresponding to the closed position) shown in FIG. 1A, with the valve disc 3b closing off the vapor tap orifice 2. This effectively prevents liquid from escaping from the container via the vapor tap orifice, even though the liquid is now on the other side of the container. The dip tube 32 now taps the gas phase, and thus it is quite impossible for liquid to escape from the container. Accordingly, a flammability hazard due to the escape of flammable liquid is avoided.

At the same time, the shut-off valve 8b prevents a flame hazard due to the entry of liquefied propellant into the valve chamber 5 when the container is shaken before opening the delivery valve. With the valve 8b closing off the aperture 29 in the valve plate 28, both liquid through the liquid tap orifice 5a and gas or liquefied propellant through the vapor tap orifice 2 are prevented from entering the valve chamber 5, so that the valve chamber is kept relatively free of aerosol composition when the container is shaken to distribute or disperse insoluble material more uniformly through the composition, before opening the delivery valve. Since the valve chamber 5 is empty, or virtually so, liquefied flammable propellant is not delivered from the valve when the delivery valve is opened, during the first few seconds of the delivery. Thus, again, a flame hazard due to the escape of flammable liquid propellant is avoided.

This container is capable of delivering a dispersion type aerosol antiperspirant composition of conventional formulation at a delivery rate of about 0.4 g/second, about 40% of the normal delivery rate of 1 g/second. Accordingly, in order to obtain the same delivery of active ingredients (such as active antiperspirant) per squirt of a unit time, it is necessary to considerably increase the concentration of active antiperspirant composition. Normally, such compositions contain less than 5% active antiperspirant, because of clogging problems using standardized aerosol container valve systems and dimensions. In this container, however, it is possible to deliver at a low delivery rate about 0.3 to about 0.7 g/second of aerosol antiperspirant composition containing from about 8% to about 20% active ingredient as suspended or dispersed solid material without clogging, because of the high proportion of gas to liquid.

The vapor tap valve 40 shown in FIGS. 3 and 4 is generally similar to that of FIGS. 1, 1A and 2, and consequently like reference numerals are used for like parts. In this embodiment, the shut-off valve 45 of the invention reciprocates in aperture 44 in the bottom wall 6b of the valve chamber 5, and the valve plate 28 is eliminated. The shut-off valve 45 is downstream of both the liquid tap orifice 41 and the vapor tap orifice 42, and consequently all flow from either orifice into the valve chamber 5 is prevented when the shut-off valve is in the closed position, closing aperture 44, as shown in FIGS. 3 and 4.

In this container the vapor tap valve 40 of the invention has a valve stem 11 having a valve button 12 attached at one end, with valve button passages 16, 17 and a delivery orifice 14 therethrough, and a valve housing 6 pinched by crimp 23b in the aerosol container cap 23. The valve housing 6 has a valve chamber 5, and an aperture 44 in bottom wall 6b, the walls of which serve as a valve seat for the shut-off valve tip 45 of the valve stem 11. The delivery valve portion of the valve stem 11 is in the form of a valve poppet 8*d*. The valve stem orifice 13*a* is closed off by the poppet when the delivery valve is in the closed position, seen in FIG. 3. The valve poppet 8*d* is reciprocably mounted on the valve stem 11, as also is the shut-off valve 45, and both are biased by the spring 18 against the valve seat 19 on the inside face of the gasket 9, in the normally closed position. When the valve poppets 8*d* and 45 are away from their seats, the valve stem orifice 13*a* is in flow communication via the valve chamber with the liquid tap orifice 41 and the vapor tap orifice 42.

The valve housing 6 in the portion below the shut-off valve 45 is provided with a tapered passage 46 which is shaped to receive the end 32*a* of the capillary dip tube 32.

The liquid aerosol composition is stored in the lower portion 21 of the container, and the dip tube 32 extends from the lower portion 21 of the container into the passage 5*c* of the valve housing 6 in which it is pressfitted in place. The dip tube puts the liquid phase in the bottom of the container in flow connection with the liquid passage 41.

The second slide valve 3 has a valve body of metal, for example, stainless steel or aluminum, with an annular rim 3*a* and a central disc valve 3*b*. The rim defines a recess 3*d* which is wide enough to embrace and conform to the cylindrical tail piece 6*f* of the valve housing 6. When the valve 3 is in the uppermost position, on the end 6*d* of the valve housing, the disc valve 3*b* covers over vapor tap orifice 42 and abuts the bottom wall 6*b* of the valve housing 6, thus effectively closing off the vapor tap orifice 2*a*. When the valve 3 is in its lowermost position, it engages the stop 6*h* on the tail piece 6*f*.

The disc valve 3*b* has a central aperture 15, which fits loosely over the tail piece 6*f* of the valve housing 6. The loose fit prevents binding of the disc against the tail piece 6*f*. In the open position, the valve disc 3*b* rests against the stop 6*d*, as shown in the Figure In this position, the container is upright, vapor tap orifice 42 is open, and the second shut-off valve under the force of gravity remains in the lowermost position.

It will be apparent however that when the container is inverted, the valve 3 will tend to slide along the tail piece 6*f*, into the newly lowermost position corresponding to the closed position, with the valve disc 3*b* closing off the vapor tap orifice 42. This effectively prevents liquid from escaping from the container via the vapor tap orifice, even though the liquid is now on the other side of the container. The dip tube 32 now taps the gas phase, and thus it is quite impossible for liquid propellant to escape from the container. Accordingly, a flame hazard when the container is inverted due to the escape of flammable liquid is avoided.

In the aerosol container shown in FIGS. 5 and 6, the vapor tap valve of the invention is employed in a pressure bottle. In this embodiment, the delivery valve 60 is the same as that of FIGS. 3 and 4, and the shut-off valve 55 is similar. Upstream of the shut-off valve 55 and the vapor tap orifice 51 is a capillary dip tube flow passage 53 through the housing 6, in flow communication at one end with the upper end of the capillary dip tube 52 and at the other end with the valve chamber 61.

Upstream of the vapor tap orifice 51 within the valve housing 6 in a chamber 54 between the two sections of the vapor tap orifice 51 is a second shut-off valve 65, designed to close off the vapor tap orifice 51 when the container is inclined to below the horizontal, or inverted.

This shut-off valve comprises a ball 58 of inert noncorrodible metal such as aluminum, stainless steel, or brass, which is free to roll within the valve chamber 54. The valve seat is defined by the concave recess 59 in the wall of the chamber adjacent the two sections of orifice 61. The recess 59 is tapered sufficiently to guide the ball 58 and permit it to lodge against the orifice 51, closing it off, when the container is inverted or inclined below the horizontal.

In the normal upright position of the container, as shown in FIG. 5, the ball 58 is at the bottom of the chamber 54. Accordingly, when the actuator button 12 is depressed, the shut-off valve 55 is opened, as well as the delivery valve 60, and liquid aerosol composition can be drawn up through the dip tube 52 into the valve chamber 61, while vapor phase propellant gas from the head space 62 can enter the valve chamber 61 through the vapor tap orifice 51. Thus, the container acts normally when it is in this position, and in fact in all positions above the horizontal, since the ball then tends under gravity to remain in the position shown.

When however the container is inverted so the delivery valve 60 is below the horizontal, the ball 58 is free to roll along the side walls of the chamber 54, and when it does so, it moves against the gas tap orifice 51, closing it off. It is guided thereby the concave walls of the recess 59. It is held in this position by gravity. This prevents the escape of liquid propellant through the vapor tap orifice 51 into the passage 53 and from there to the valve stem passage and delivery port, thus avoiding a flame hazard.

In this embodiment the pressure bottle has a much smaller opening for the valve assembly than an aerosol can; in this case, 1.2 cm in diameter, as compared to a 2.5 cm opening for an aerosol can. The vapor tap valve of the invention is mounted across this opening in the cap for the pressure bottle, as in the can embodiments illustrated previously. The upper neck of the bottle is provided with a bulge, and the pressure bottle cap is crimped at its lower edge to retain the cap and the valve to the bottle in a leak-tight seal provided by the rubber gasket.

The vapor tap valve shown in FIGS. 7 and 8 utilizes a slide valve as the shut-off valve. As seen in FIGS. 7 and 8, the valve housing 70 has a valve chamber 71 at the upper portion, and a blending chamber or space 72 below the valve chamber. A wall 73 with a central opening 74 separates the valve chamber from the blending space.

The vapor tap valve 75 has a valve stem 76 with a valve stem orifice 77 therethrough in flow communication with the valve chamber 71 when the delivery valve is in the open position. In the closed position, the valve stem orifice 77 is sealed off by the gasket 9.

Beyond the valve stem orifice 77, the valve stem 76 extends as a solid rod. In the other direction the valve stem 76 includes a valve stem passage 78, which is in fluid flow connection with valve button passages 16 and 17 of the valve button 12 and a delivery orifice 14 at the end of the valve button passage 17. The solid portion 79 of the valve stem extends all the way across the valve chamber 71, and through the aperture 74. At the tip end of the stem 79 is a slot 80, which when the valve is in the open position as shown in dashed lines in FIGS. 7 and 8 registers with and communicates the blending space 72 with the valve chamber 71. In the closed position shown in solid lines, the lower portion of the slot 80 is closed off by the wall 73. Consequently, all flow from the blending space 72 into the chamber 71 is closed off when the delivery valve is in the closed position, and the valve chamber cannot therefore be filled with either gas or liquid from the blending space 72.

Through the wall of the housing 70 is a vapor tap orifice 81, and a liquid tap orifice 82 in the form of the open capillary passage through a capillary dip tube 83 extending to the bottom of the container. Since the valve stem 79 is downsteam of both the vapor tap and the liquid tap orifices, neither gas nor liquid can pass into the valve chamber 71 when the valve is closed.

Slidably retained within the blending space 72 is a shut-off valve 85, in the form of an annular ring, with a central aperture 86 therethrough. The ring is free to slide within the blending space 72. When the valve is in the upright position, as shown in FIGS. 7 and 8, the ring is at the lower portion of the blending space. When the valve is inverted, the ring falls by gravity to the other end of the blending space, abutting the solid portion 79 of the valve stem.

The liquid aerosol composition is stored in the portion 21 of the container, and the dip tube 83 extends through the lower portion 21 of the container into blending space 72, being inserted into one end of this space through the open end of the valve housing 70. The dip tube puts the liquid phase 29 in the bottom of the container in flow connection with the blending space 72. The vapor tap orifice 81 communicates the upper portion 22 of the container with the blending space 72, and thus puts the gas phase in the upper portion of the container in flow connection with the blending space 72.

The slide valve 85 has a valve body of metal, for example, stainless steel or aluminum, and the central opening 86 is just wide enough to accommodate the tip end 79 of the valve stem in sealing relationship. The valve 85 is long enough so that when the valve is inverted and the valve stem 79 is pushed inwardly by the button actuator 12 as far as it can go, the slot 80 is still not in flow communication with the blending space 72, being closed off by the ring 85. Thus, when the valve is in the inverted position, with the slide valve 85 at the upper end of the blending space 72, the valve 85 effectively closes off the slot 80, and prevents passage of both liquid and gas from the blending space 72 into the valve chamber 71, and thence eventually through the delivery port 14. Accordingly, a flame hazard when the container is inverted due to escape of flammable liquid is avoided.

The vapor tap valve of the invention can be used in any kind of aerosol container to deliver any aerosol composition in the form of a spray. The range of products that can be dispensed is diverse, and includes pharmaceuticals for spraying directly into oral, nasal and vaginal passages, antiperspirants, deodorants, hair sprays, fragrances and flavors, body oils, insecticides, window cleaners and other cleaners, spray starches and polishes for autos, furniture and shoes.

Having regard to the foregoing disclosure, the following is claimed as the inventive and patentable embodiments thereof:

1. A vapor tap valve for use in aerosol containers with aerosol compositions containing liquefied flammable propellants, inhibiting delivery of flammable liquid propellant when the valve is opened immediately after shaking the container and contents, comprising, in combination, a delivery valve movable manually between open and closed positions and including a valve stem, a delivery port, and a valve chamber; bias means in the valve chamber biasing the delivery valve towards a closed position; a liquid tap orifice in flow communication with the valve chamber; a vapor tap orifice in flow communication with the valve chamber; an aperture forming a passage to the valve chamber and putting the valve chamber in flow communication with at least one of (a) the vapor tap orifice and (b) both the vapor tap orifice and the liquid tap orifice; and a shut-off valve linked to and movable with the delivery valve, closing off the aperture and thereby closing off the flow communication from the vapor tap orifice to the valve chamber against entry of liquefied propellant therethrough into the valve chamber when the delivery valve is closed, and opening the aperture and thereby the flow communication from the vapor tap orifice to the valve chamber when the delivery valve is manually moved to the open position, against the biasing force of the bias means.

2. A vapor tap valve according to claim 1, in which the shut-off valve closes off the aperture and thereby flow communication between the valve chamber and both the vapor tap orifice and the liquid tap orifice against entry of liquefied propellant therethrough into the valve chamber.

3. A vapor tap valve according to claim 1, comprising a second shut-off valve responsive to orientation of the aerosol container to move automatically between positions opening and closing off flow of propellant to the delivery port via the valve chamber, the shut-off valve moving into an open position in an orientation of the container between a horizontal and an upright position, and moving into a closed position in an orientation of the chamber between the horizontal and an inverted position.

4. A vapor tap valve according to claim 1, comprising a valve housing defining the valve chamber, and the delivery valve is movably disposed in the valve chamber for movement between open and closed positions, away from and towards a valve seat at the inner end of the valve stem passage, with which the valve chamber is in flow connection when the delivery valve is open.

5. A vapor tap valve according to claim 1, in which the valve chamber has a volume not exceeding 1 cc.

6. A vapor tap valve according to claim 1, in which the liquid tap orifice communicates the valve chamber with a capillary dip tube.

7. A vapor tap valve according to claim 1, in which the liquid tap orifice communicates the valve chamber with a standard dip tube.

8. A vapor tap valve according to claim 1, comprising a tail piece valve housing and a dip tube, and a tail piece having a through passage in fluid flow connection with the dip tube, and the valve chamber.

9. A vapor tap valve according to claim 1, in which both the delivery valve and the shut-off valve are attached to and move with the valve stem, against the biasing force of the bias means.

10. A vapor tap valve according to claim 9, in which the shut-off valve is a slide valve defined by the outer periphery of a portion of the valve stem and the inner periphery of an aperture in a wall of the valve chamber.

11. A vapor tap valve according to claim 10, in which the valve stem includes a flow passage therethrough which in the open position of the shut-off valve communicates the valve chamber with the vapor tap orifice.

12. An aerosol container for use with aerosol compositions containing liquefied flammable propellants inhibiting delivery of flammable liquid propellant when the valve is opened immediately after shaking the container and contents, comprising, in combination, a pressurizable container having at least one storage compartment and a delivery port for an aerosol composition and a liquefied propellant, in which compartment propellant can assume an orientation according to orientation of the container between a horizontal and an upright position, and a horizontal and inverted position; a vapor tap valve movable manually between open and closed positions and including a valve stem, a delivery port, and a valve chamber, bias means in the valve chamber biasing the delivery valve towards a closed position; a liquid tap orifice in flow communication with the valve chamber; a vapor tap orifice in flow communication with the valve chamber; an aperture forming a passage to the valve chamber and putting the valve chamber in flow communication with at least one of (a) the vapor tap orifice and (b) both the vapor tap orifice and the liquid tap orifice; and a shut-off valve linked to and movable with the delivery valve, closing off the aperture and thereby closing off the flow communication from the vapor tap orifice to the valve chamber against entry of liquefied propellant therethrough into the valve chamber when the delivery valve is closed, and opening the aperture and thereby the flow communication from the vapor tap orifice to the valve chamber when the delivery valve is manually moved to the open position, against the biasing force of the bias means; an aerosol-conveying passage including the valve chamber in flow connection at one end with the storage compartment and at the other end with the delivery port, the vapor tap valve being disposed across the aerosol-conveying passage in a manner to control flow therethrough, manipulation of the delivery valve opening and closing the passage to flow of aerosol composition and propellant from the storage compartment to the delivery port.

13. An aerosol container according to claim 12, comprising a second shut-off valve disposed across the aerosol-conveying passage in a manner to control flow therethrough and responsive to orientation of the container to move automatically between positions opening and closing off flow of liquefied propellant to the delivery port, the shut-off valve moving into an open position in an orientation of the container between a horizontal and an upright position, and moving into a closed position in an orientation of the container between the horizontal and an inverted position.

14. An aerosol container according to claim 13, in which the second shut-off valve comprises a valve seat, a valve passage through the valve seat, and a free-rolling ball valve adapted to roll into engagement with the valve seat and close off the valve passage at an orientation of the container between the horizontal and an inverted position, and adapted to roll away from the valve seat and open the valve passage at an orientation of the container between the horizontal and an upright position.

15. An aerosol container according to claim 14, in which the vapor tap valve includes a valve housing receiving one end of a dip tube, and the ball valve, valve passage and valve seat are disposed within the valve housing.

16. An aerosol container according to claim 14, in which the vapor tap valve includes a valve housing receiving one end of a dip tube, and the ball valve, valve passage and valve seat are disposed within the valve chamber.

17. An aerosol container according to claim 13 in which the second shut-off valve comprises a valve seat, a valve passage through the valve seat, and a slide valve adapted to slide into engagement with the valve seat and close off the valve passage at an orientation of the container between the horizontal and an inverted position, and adapted to slide away from the valve seat and open the valve passage at an orientation of the container between the horizontal and an upright position.

18. An aerosol container according to claim 17, in which the slide valve comprises a valve body having a central disc portion with a central aperture therethrough receiving a central valve guide, and an annular peripheral rim portion embracing an outer valve guide.

19. An aerosol container according to claim 18, in which the vapor tap valve includes a valve housing receiving one end of a dip tube, the central valve guide is the dip tube, and the outer valve guide is the valve housing.

20. An aerosol container according to claim 19, in which the slide valve in the closed position closes off the vapor tap orifice.

21. An aerosol container according to claim 20, in which the vapor tap orifice is in a bottom wall of the valve housing, and the disc portion closes off the vapor tap orifice.

22. An aerosol container according to claim 20, in which the side wall of the valve housing includes a vapor tap orifice, and the slide valve in the rim portion closes off the vapor tap orifice.

23. An aerosol container for use with liquid aerosol compositions containing liquefied flammable propellants, inhibiting delivery of flammable liquid propellant when the valve is opened immediately after shaking the container and contents, comprising, in combination, a pressurizable container having a delivery valve movable between open and closed positions, a valve stem, and a delivery port; a valve stem orifice in the valve stem in flow connection at one end with a valve chamber and at the other end with an aerosol-conveying valve stem passage leading to the delivery port; the valve stem orifice having a diameter within the range from about 0.3 to about 0.65 mm; bias means for holding the valve in a closed position; means for manipulating the valve against the bias means to an open position for expulsion of aerosol composition via the valve stem orifice to the delivery port; wall means defining the valve chamber and separating the valve chamber from liquid aerosol composition and propellant within the container; at least one liquid tap orifice through the wall means, having a cross-sectional open area within the range from about 0.1 to about 0.8 mm for flow of liquid aerosol composition into the valve chamber; at least one vapor tap orifice through the wall means, having a cross-sectional open area within the range from about 0.1 to about 0.8 mm for flow of propellant into the valve chamber; the ratio of liquid tap orifice to vapor tap orifice cross-sectional open area being within the range from about 0.5 to about 2.5; the open areas of the liquid tap orifice and vapor tap orifice being selected within the stated ranges to provide a volume ratio of propellant gas:liquid aerosol composition within the range from about about 8:1 to about 40:1, thereby limiting the delivery rate of liquid aerosol composition and propel any gas from the container when the delivery valve is opened; an aperture forming a passage to the valve chamber and putting the valve chamber in flow communication with at least one of (a) the vapor tap orifice and (b) both the vapor tap orifice and the liquid tap orifice; and a shut-off valve linked to and movable with the delivery valve, closing off the aperture and thereby closing off the flow communication from the vapor tap orifice to the valve chamber against entry of liquefied propellant therethrough in the valve chamber when the delivery valve is closed, and opening the aperture and thereby the flow communication from the vapor tap orifice to the valve chamber when the delivery valve is manually moved to the open position, against the biasing force of the bias means.

24. An aerosol container according to claim 23, comprising a second shut-off valve responsive to orientation of the container to move automatically between positions opening and closing off flow of liquefied propellant to the delivery port, the shut-off valve moving into an open position in an orientation of the container between the horizontal and an upright position, and moving into a closed position in an orientation of the container between the horizontal and an inverted position.

25. An aerosol container according to claim 23, in which the liquid tap orifice is a capillary dip tube whose cross-sectional open area is within the range from about 0.1 to about 1.8 mm, for flow of liquid aerosol composition into the valve chamber; the vapor tap orifice through the wall means has a cross-sectional open area within the range from about 0.1 to about 0.8 mm for flow of propellant gas into the valve chamber; and the ratio of capillary dip tube to vapor tap cross-sectional open area is within the range from about 1.0 to about 3.2.

* * * * *

UNITED STATES PATENT AND TRADEMARK OFFICE

CERTIFICATE OF CORRECTION

PATENT NO. : 4,116,370

DATED : September 26, 1978

INVENTOR(S) : J. George Spitzer et al.

It is certified that error appears in the above-identified patent and that said Letters Patent is hereby corrected as shown below:

Column 10, line 30, "representa" should read -- represents --.

Column 13, line 30, "if" should read -- it --.

Signed and Sealed this

*Fourth* Day of *June 1985*

[SEAL]

*Attest:*

DONALD J. QUIGG

*Attesting Officer* *Acting Commissioner of Patents and Trademarks*